United States Patent [19]

Resch et al.

[11] 4,100,945

[45] Jul. 18, 1978

[54] APPARATUS FOR WITHDRAWING LENO WASTE IN WEAVING MACHINES

[75] Inventors: Josef Resch, Rychnov nad Kneznou; Jan Matuska; Jindrich Trejtnar, both of Tyniste nad Orlici, all of Czechoslovakia

[73] Assignee: Elitex Koncern textilniho strojirenstvi, Liberec, Czechoslovakia

[21] Appl. No.: 700,402

[22] Filed: Jun. 28, 1976

[30] Foreign Application Priority Data

Aug. 25, 1975 [CS] Czechoslovakia ..... 5775-75

[51] Int. Cl.[2] ..... D03D 49/00

[52] U.S. Cl. ..... 139/291 C; 226/97; 226/187; 139/302

[58] Field of Search ..... 139/291 R, 291 C, 304, 139/307, 308, 302, 303; 226/97, 187

[56] References Cited

U.S. PATENT DOCUMENTS

| | | | |
|---|---|---|---|
| 3,461,920 | 8/1969 | Sakamoto | 139/302 |
| 3,649,381 | 3/1972 | Mayhew | 226/97 |
| 3,771,702 | 11/1973 | Matsumo et al. | 226/97 |

*Primary Examiner*—Henry S. Jaudon

[57] ABSTRACT

A pair of parallel rollers disposed in a path of advance of leno waste exiting from a leno weave portion of a weaving machine are provided with facilities for maintaining their peripheries free of the leno waste as such waste advances through the roller nip. Each of the rollers is made hollow, and is provided with a plurality of peripheral apertures for continually ejecting pressurized air axially introduced into the hollow interior of the cylinder by a fitting in its end wall. Each of the so-apertured cylinders is disposed within a contoured housing which necks down in the leno waste-advancing direction from a relatively wide, convex central portion to relatively narrow inlet and outlet end portions through which the waste enters and exits from the roller nip. As a result, pressurized air emerging from the peripheral apertures of the rollers is directed radially outward through each of the narrow end ports of the housing to entrain the leno waste and to continuously clean the periphery of the cylinders.

1 Claim, 2 Drawing Figures

APPARATUS FOR WITHDRAWING LENO WASTE IN WEAVING MACHINES

BACKGROUND OF THE INVENTION

The invention relates to apparatus for withdrawing leno waste in weaving machines, and more particularly to apparatus of such type which includes a pair of positively-driven rollers that cooperate to define a leno waste-advancing nip therebetween.

In known apparatus of this type, the advance of the leno waste through the roller nip causes portions of such waste to adhere to the periphery of the cooperating rollers, as by wrapping itself around the peripheral wall. Such waste must be removed periodically from the periphery to prevent loss of efficiency, and eventual malfunction, of the waste-advancing section. In the past, such removal has been accomplished with the use of comb-like teeth on the roller periphery and/or by physically stopping the machine to hand-remove the material. Such methods have proven slow and cumbersome.

SUMMARY OF THE INVENTION

The leno waste-advancing section constructed in accordance with the invention is designed to avoid these disadvantages. In an illustrative embodiment, each of the rollers is made hollow, and is provided with a plurality of peripheral apertures through which air or other pressurized gas introduced axially into the hollow interior of the cylinders may exit to continually clear the periphery of leno waste tending to adhere thereto.

In addition, the cooperating rollers are disposed in a convex central portion of a contoured housing which necks down in the direction of advance of the leno waste toward a pair of narrow end portions disposed upstream and downstream, respectively, of the rollers. The smooth contour of the housing directs the pressurized air exiting from the peripheral apertures of the rollers in a direction axially outward through both of the narrow end ports, thereby effectively entraining the leno waste and tensioning it along the axis of advance to maintain the waste in spaced relation to the roller periphery.

BRIEF DESCRIPTION OF THE DRAWING

The invention is further set forth in the following detailed description taken in conjunction with the appended drawing, in which.

DETAILED DESCRIPTION

Figure 1:
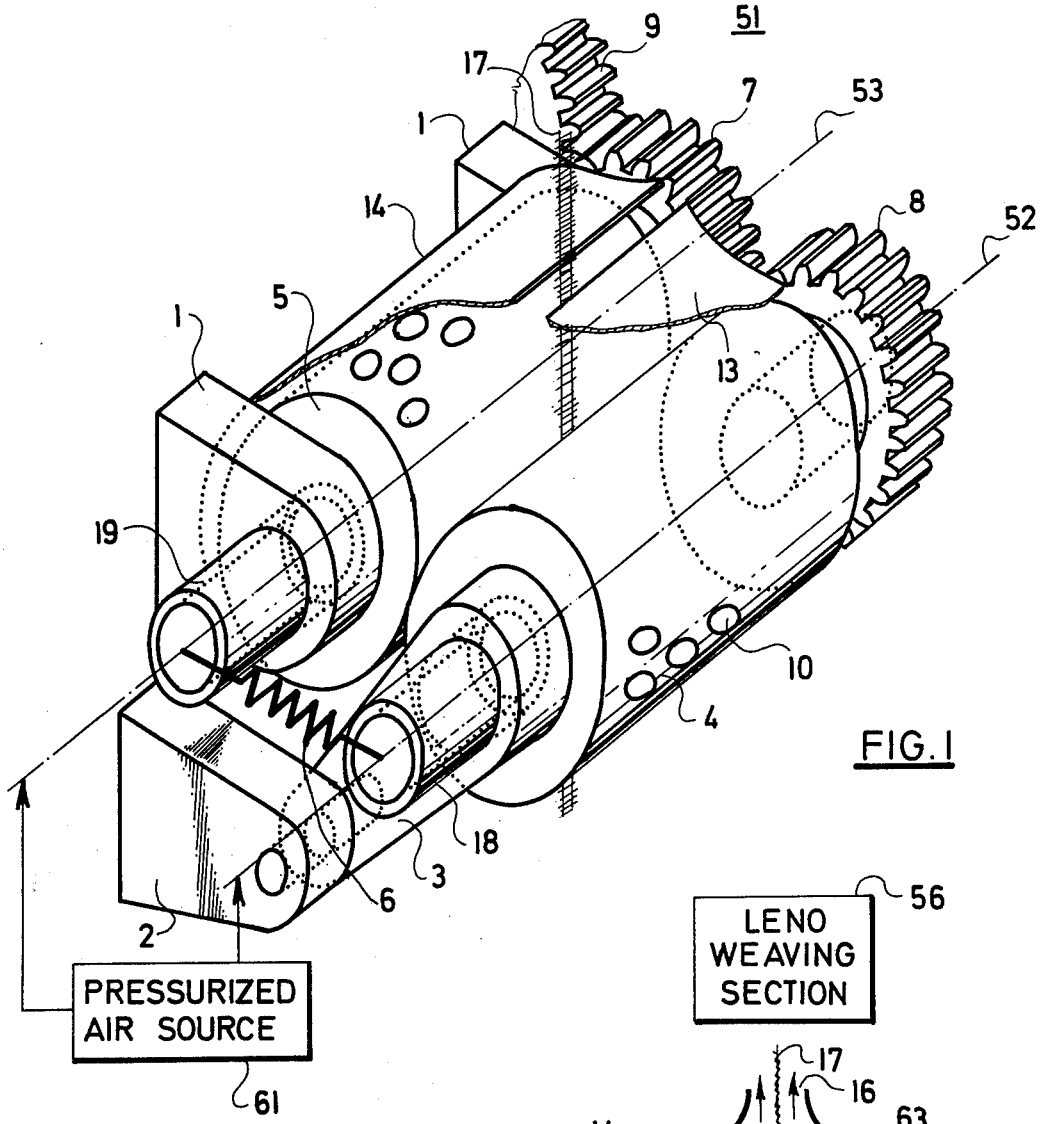
FIG. 1 is a perspective view of a leno waste-advancing section constructed in accordance with the invention.

Referring now to the drawing, the leno waste-advancing apparatus represented generally at 51 includes a pair of spaced brackets 1, 2 associated with a conventional weaving machine (not shown). An arm or shaft 3 is journalled for rotation in the bracket 2 and is suitably affixed to a first roller 4 of the withdrawing section 51 for rotation of the roller 4 about a first axis 52.

A second roller 5 is similarly supported on a second arm or shaft (not shown) that is suitably journalled for rotation in the other bracket 1 for rotation about a second axis 53 which is parallel to the axis 52 of the first roller 4. The rollers 4 and 5 bear against each other and the mutual pressure between them is adjustable by means of a spring 6.

Figure 2:
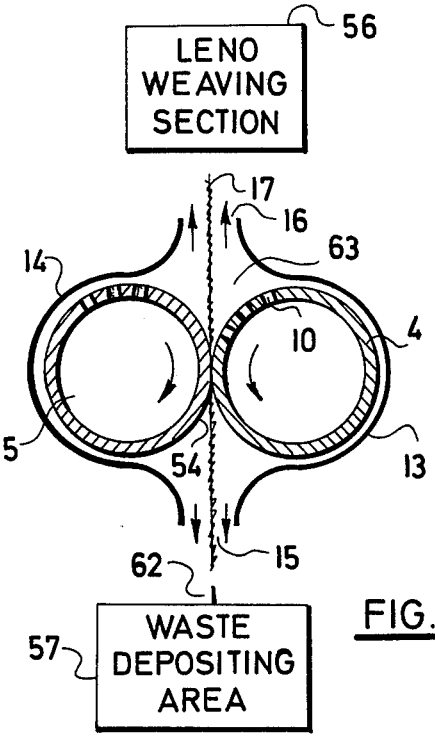
FIG. 2 is a transverse sectional view of the arrangement of FIG. 1, showing details of a contoured housing surrounding the cylinders of the advancing section.

The rollers 4 and 5 are disposed in adjacent relation, and as indicated best in FIG. 2 are adapted to cooperate to define a leno waste-advancing nip area 54 therebetween.

Adjacent end portions of the rollers 4 and 5 are respectively connected to cooperating gears 8, 7, the latter being driven by a gear 9 associated with the main drive of the weaving machine. Thus, when the gear 9 is rotated, the rollers 4 and 5 are positively driven in opposite directions as shown in FIG. 2 via the rotation of the associated gears 8, 7. Such rotation is effective, in a conventional manner, to linearly advance a section 17 of leno waste from a leno weaving section 56 of the weaving machine to a waste-depositing area 57.

In the past, leno waste-advancing roller arrangements such as the type thusfar described have suffered the disadvantage that a portion of the leno waste advancing through the nip area 54 has tended to wrap around and adhere to the rotating peripheral walls of the associated rollers 4, 5. In accordance with the invention, the periphery of the cylinders is effectively maintained free of such leno waste by the pneumatic facilities now to be described.

In particular, each of the rollers 4 and 5 is formed as a hollow cylinder, and each exhibits a plurality of peripheral apertures 10, 10 which communicate with the hollow interior of the associated cylinder. As shown best in FIG. 1, air or other pressurized gas from a suitable source 61 is directed to the interior of each of the cylinders 4 and 5 via a pair of hollow end fittings 18, 19. The pressurized air introduced into the cylinders continuously leaves the interior thereof via the peripheral apertures 10, thereby blowing off any of the leno waste tending to accumulate on the periphery.

In addition, the withdrawing section 51 includes a contoured housing 14 which, as indicated in FIG. 2, is symmetrically situated with respect to an axis 62 of advance of the leno waste 17, such axis being in turn perpendicular to the axes of rotation 52, 53 of the rollers 4 and 5.

The housing 14 includes a relatively wide, convex central portion 63 conforming to and disposed radially outward of the peripheries of the respective rollers 4, 5. The central portion cooperates with, and necks down to terminate at, a pair of relatively narrow end sections 15, 16 which are spaced apart in the direction of the axis 62 and which respectively surround the outgoing and incoming portions, respectively, of the waste 17. The so-contoured shape of the housing 14 aids in directing the pressurized air exiting from the peripheral apertures 10 of the cylinders 4, 5 in axially opposite directions as shown to exit from the respective end ports 15, 16 of the housing 14. The effect of this is to tension the advancing leno waste 17 and to entrain such waste in the air stream exiting in opposite directions through the ports 15, 16, thereby tending to confine the waste along the direction 62 and thereby tending to keep such waste off the periphery of the rollers 4, 5.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In an apparatus for withdrawing leno waste in a weaving machine, comprising first and second rollers having parallel axes of rotation and disposed in adjacent relation to define a leno waste-advancing nip area therebetween to which the leno waste is introduced so that the rollers normally contact the leno waste only in the nip area, and means associated with the weaving machine for positively driving the first and second rollers to advance the introducing leno waste through the nip area in a first direction perpendicular to the axes of the rollers, the improvement in which the rollers are hollow cylinders having a plurality of peripheral apertures communicating with the hollow interior thereof and in which the apparatus further comprises means associated with each cylinder for introducing a pressurized gas axially into the interior of the respective cylinders to exit from the associated peripheral apertures thereof, whereby portions of the leno waste tending to adhere to a section of each roller as such section has passed through the nip area will be propelled away from the section, the apparatus further comprising a contoured housing surrounding the first and second cylinders and extending in the first direction, the housing having a relatively wide, convex central portion disposed radially outwardly from the periphery of the respective cylinders and a pair of axially opposed, relatively narrow inlet and outlet end portions individually surrounding the path of advance of the leno waste upstream and downstream, respectively, of the central portion, whereby pressurized gas exiting from the peripheral apertures of the first and second cylinders within the central portion of the housing is propelled symmetrically and axially outward through the inlet and outlet end ports of the housing to entrain and tension the leno waste advancing through the housing.

* * * * *